US009303457B2

(12) United States Patent
Pabon et al.

(10) Patent No.: US 9,303,457 B2
(45) Date of Patent: Apr. 5, 2016

(54) DIRECTIONAL DRILLING USING MAGNETIC BIASING

(75) Inventors: Jahir Pabon, Newton, MA (US); Geoffrey Charles Downton, Minchinhampton (GB)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 432 days.

(21) Appl. No.: 13/586,653

(22) Filed: Aug. 15, 2012

(65) Prior Publication Data

US 2014/0048334 A1 Feb. 20, 2014

(51) Int. Cl.
*E21B 7/08* (2006.01)
*E21B 7/06* (2006.01)

(52) U.S. Cl.
CPC .. *E21B 7/06* (2013.01); *E21B 7/062* (2013.01)

(58) Field of Classification Search
CPC ..... E21B 4/04; E21B 7/062; E21B 7/08
See application file for complete search history.

(56) References Cited

U.S. PATENT DOCUMENTS 4,291,773 A * 9/1981 Evans ..... 175/61
5,113,953 A 5/1992 Noble
5,265,682 A 11/1993 Russell et al.
5,520,255 A 5/1996 Barr et al.
5,553,678 A 9/1996 Barr et al.
5,553,679 A 9/1996 Thorp
5,582,259 A 12/1996 Barr
5,603,385 A 2/1997 Colebrook
5,673,763 A 10/1997 Thorp
5,685,379 A 11/1997 Barr et al.
5,695,015 A 12/1997 Barr et al.
5,706,905 A 1/1998 Barr
5,778,992 A 7/1998 Fuller
5,803,185 A 9/1998 Barr et al.
5,971,085 A 10/1999 Colebrook
6,089,332 A 7/2000 Barr et al.
6,092,610 A 7/2000 Kosmala et al.
6,116,354 A * 9/2000 Buytaert ..... 175/55
6,158,529 A 12/2000 Dorel
6,244,361 B1 6/2001 Comeau et al.
6,364,034 B1 4/2002 Schoeffler
6,394,193 B1 5/2002 Askew
7,188,685 B2 3/2007 Downton et al.
7,975,780 B2 7/2011 Siher et al.
2001/0052428 A1 12/2001 Larronde et al.
2002/0011359 A1 1/2002 Webb et al.
2006/0249287 A1 11/2006 Downton et al.
2011/0120725 A1* 5/2011 Downton et al. ..... 166/373

FOREIGN PATENT DOCUMENTS

GB 2430686 A 4/2007
WO 0068542 A1 11/2000

OTHER PUBLICATIONS

Combined Search and Examination Report issued in GB1312987.9 on Jan. 8, 2014, 6 pages.

* cited by examiner

*Primary Examiner* — Cathleen Hutchins
(74) *Attorney, Agent, or Firm* — Bridget Laffey

(57) ABSTRACT

Apparatus and methods are disclosed for directionally drilling an earth formation where magnet arrays are utilized to provide net lateral force between a first member coupled to a drill bit and another member that either extends through or around the first member.

35 Claims, 9 Drawing Sheets

DIRECTIONAL DRILLING USING MAGNETIC BIASING

FIELD

The subject disclosure generally relates to the field of drilling oil, gas and water wells. More particularly, the subject disclosure relates to methods and apparatus for steering the direction of drilling a well so as to follow a desired trajectory.

BACKGROUND

Directional drilling of a subsurface formation may be advantageous for any of several reasons. By way of example, directional drilling can increase the length of the wellbore through a reservoir that is to be produced. Also, directional drilling can permit access to reservoirs where vertical access is difficult or not possible. Directional drilling may allow more wellheads to be grouped together at a surface location, thereby reducing surface area disturbance and reducing rig moves.

A directional drilling path is often predetermined before drilling commences, and a downhole instrument may be utilized to provide the inclination and azimuth of the wellbore during the drilling process. This is particularly true of measurement while drilling (MWD) tools that provide "real-time" feedback during drilling.

Presently, there are various directional drilling systems available. Most common are "rotary steerable systems" or "RSS." The assignee hereof provides various options in an RSS, including the PowerDrive, PowerDrive Xceed, PowerDrive Archer and PowerDrive Vortex systems.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

In some embodiments, the subject disclosure relates to methods and apparatus for directional drilling of subsurface formations utilizing magnetic biasing.

In some embodiments, the subject disclosure relates to methods and apparatus for directional drilling using magnets of a first polarity located around one element of a drilling operation, and magnets of the first polarity located partially, e.g., half-way around a second element of the drilling operations and magnets of a second polarity located partially, e.g., the other half-way around the second element. By controllably locating the rotational orientation of the second element, the first or second element may be bent or steered, thereby ultimately steering a drilling bit coupled to the first or second element.

In certain embodiments, a drilling operation utilizes a drill collar, a drill bit coupled to the drill collar and an essentially geostationary mandrel located radially inward of the collar. By placing magnets around the inside of the collar and around the outside of the mandrel, appropriately selecting the polarity of the magnets, and selecting the rotational orientation of the geostationary mandrel, the drill collar may be controllably bent, resulting in the drill bit being controllably steered.

In other embodiments, a drilling operation utilizes a drill collar, a drill bit, a steering element having a universal joint that couples the drill bit to the drill collar, and an essentially geostationary mandrel located radially inward of the mandrel. By placing magnets around the inside of the universal joint steering element and the outside of the essentially geostationary mandrel, appropriately selecting the polarity of the magnets, and selecting rotational orientation of the geostationary mandrel, the steering element may be directed, thereby resulting in the drill bit being controllably steered.

In other embodiments, a drilling operation utilizes a stabilized collar having a controllable rotational orientation and drive shaft coupled to a drill bit. By placing magnets around the inside of the collar and around the outside of the drive shaft, appropriately selecting the polarity of the magnets, and controlling the rotational orientation of the collar, the drill bit can be controllably steered.

In yet other embodiments, a drilling operation utilizes a drive shaft coupled to a drill bit, an essentially geostationary sleeve located about the drive shaft, and a collar. By placing magnets around the inside of the collar and around the outside of the essentially geostationary sleeve, appropriately selecting the polarity of the magnets, and controlling the rotational orientation and/or axial location of the collar, the drive shaft can be directed, thereby controllably steering the drill bit.

Further features and advantages of the subject disclosure will become more readily apparent from the following detailed description when taken in conjunction with the accompanying drawings.

BRIEF DESCRIPTION OF THE DRAWINGS

The subject disclosure is further described in the detailed description which follows, in reference to the noted plurality of drawings by way of non-limiting examples of embodiments of the subject disclosure.

DETAILED DESCRIPTION

The particulars shown herein are by way of example and for purposes of illustrative discussion of the embodiments of the subject disclosure only and are presented in the cause of providing what is believed to be the most useful and readily understood description of the principles and conceptual aspects of the subject disclosure. In this regard, no attempt is made to show structural details in more detail than is necessary for the fundamental understanding of the subject disclosure, the description taken with the drawings making apparent to those skilled in the art how the several forms of the subject disclosure may be embodied in practice.

Figure 1A:
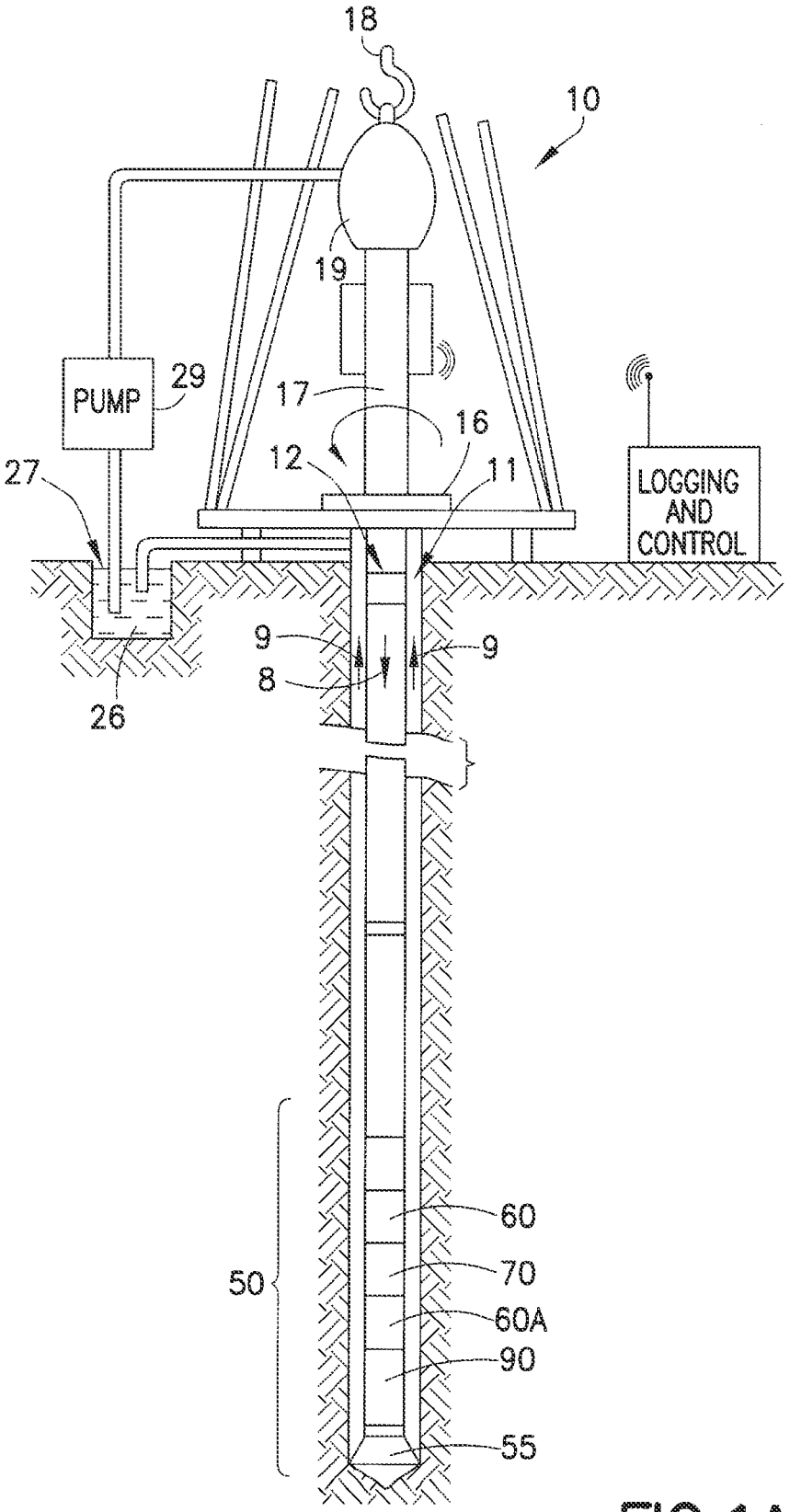
FIG. 1A is a schematic diagram of a wellsite system in which the apparatus of FIGS. 1B-8 can be employed.

FIG. 1A illustrates a wellsite system in which the presently described methods and apparatus can be employed. The wellsite can be onshore or offshore. In this exemplary system, a borehole 11 is formed in subsurface formations by rotary drilling in a manner that is well known. Embodiments of the invention can also use directional drilling, as will be described hereinafter.

A drill string 12 is suspended within the borehole 11 and has a bottom hole assembly 50 which includes a drill bit 55 at its lower end. The surface system includes platform and derrick assembly 10 positioned over the borehole 11, the assembly 10 including a rotary table 16, kelly 17, hook 18 and rotary swivel 19. The drill string 12 is rotated by the rotary table 16, energized by means not shown, which engages the kelly 17 at the upper end of the drill string. The drill string 12 is suspended from a hook 18, attached to a traveling block (also not shown), through the kelly 17 and a rotary swivel 19 which permits rotation of the drill string relative to the hook. As is well known, a top drive system could alternatively be used.

In the example of this embodiment, the surface system further includes drilling fluid or mud 26 stored in a pit 27 formed at the well site. A pump 29 delivers the drilling fluid 26 to the interior of the drill string 12 via a port in the swivel 19, causing the drilling fluid to flow downwardly through the drill string 12 as indicated by the directional arrow 8. The drilling fluid exits the drill string 12 via ports in the drill bit 55, and then circulates upwardly through the annulus region between the outside of the drill string and the wall of the borehole, as indicated by the directional arrows 9. In this well known manner, the drilling fluid lubricates the drill bit 55 and carries formation cuttings up to the surface as it is returned to the pit 27 for recirculation.

The bottom hole assembly 50 of the illustrated embodiment a logging-while-drilling (LWD) module 60, a measuring-while-drilling (MWD) module 70, a roto-steerable system and motor, and drill bit 55.

The LWD module 60 is housed in a special type of drill collar, as is known in the art, and can contain one or a plurality of known types of logging tools. It will also be understood that more than one LWD and/or MWD module can be employed, e.g., as represented at 60A. (References, throughout, to a module at the position of 60 can alternatively mean a module at the position of 60A as well.) The LWD module includes capabilities for measuring, processing and storing information, as well as for communicating with the surface equipment.

The MWD module 70 is also housed in a special type of drill collar, as is known in the art, and can contain one or more devices for measuring characteristics of the drill string and drill bit. The MWD tool further includes an apparatus (not shown) for generating electrical power to the downhole system. This may typically include a mud turbine generator powered by the flow of the drilling fluid, it being understood that other power and/or battery systems may be employed. In the present embodiment, the MWD module includes one or more of the following types of measuring devices: a weight-on-bit measuring device, a torque measuring device, a vibration measuring device, a shock measuring device, a stick slip measuring device, a direction measuring device e.g., magnetometer or gyrocompass system and an inclination measuring device.

A particularly advantageous use of the system hereof is in conjunction with controlled steering or "directional drilling." In this embodiment, a roto-steerable subsystem 90 (FIG. 1A) is provided. Directional drilling is the intentional deviation of the wellbore from the path it would naturally take. In other words, directional drilling is the steering of the drill string so that it travels in a desired direction. Directional drilling is, for example, advantageous in offshore drilling because it enables many wells to be drilled from a single platform. Directional drilling also enables horizontal drilling through a reservoir. Horizontal drilling enables a longer length of the wellbore to traverse the reservoir, which increases the production rate from the well. A directional drilling system may also be used in vertical drilling operation as well. Often the drill bit will veer off of a planned drilling trajectory because of the unpredictable nature of the formations being penetrated or the varying forces that the drill bit experiences. When such a deviation occurs, a directional drilling system may be used to put the drill bit back on course. A known method of directional drilling includes the use of a rotary steerable system ("RSS"). In an RSS, the drill string is rotated from the surface, and downhole devices cause the drill bit to drill in the desired direction. Rotating the drill string greatly reduces the occurrences of the drill string getting hung up or stuck during drilling. Rotary steerable drilling systems for drilling deviated boreholes into the earth may be generally classified as either "point-the-bit" systems or "push-the-bit" systems. In the point-the-bit system, the axis of rotation of the drill bit is deviated from the local axis of the bottom hole assembly in the general direction of the new hole. The hole is propagated in accordance with the customary three point geometry defined by upper and lower stabilizer touch points and the drill bit. The angle of deviation of the drill bit axis coupled with a finite distance between the drill bit and lower stabilizer results in the non-collinear condition required for a curve to be generated. There are many ways in which this may be achieved including a fixed bend at a point in the bottom hole assembly close to the lower stabilizer or a flexure of the drill bit drive shaft distributed between the upper and lower stabilizer. In its idealized form, the drill bit is not required to cut sideways because the bit axis is continually rotated in the direction of the curved hole. Examples of point-the-bit type rotary steerable systems, and how they operate are described in U.S. Patent Application Publication Nos. 2002/0011359; 2001/0052428 and U.S. Pat. Nos. 6,394,193; 6,364,034; 6,244,361; 6,158,529; 6,092,610; and 5,113,953 all herein incorporated by reference. In the push-the-bit rotary steerable system there is usually no identified mechanism to deviate the bit axis from the local bottom hole assembly axis instead, the requisite non-collinear condition is achieved by causing either or both of the upper or lower stabilizers to apply an eccentric force or displacement in a direction that is preferentially orientated with respect to the direction of hole propagation. Again, there are many ways in which this may be achieved, including non-rotating (with respect to the hole) eccentric stabilizers (displacement based approaches) and eccentric actuators that apply force to the drill bit in the desired steering direction. Again, steering is achieved by creating non co-linearity between the drill bit and at least two other touch points. In its idealized form the drill bit is required to cut side-ways in order to generate a curved hole. Examples of push-the-bit type rotary steerable systems, and how they operate are described in U.S. Pat. Nos. 5,265,682; 5,553,678; 5,803,185; 6,089,332; 5,695,015; 5,685,379; 5,706,905;

5,553,679; 5,673,763; 5,520,255; 5,603,385; 5,582,259; 5,778,992; 5,971,085 all herein incorporated by reference.

Figure 1B:
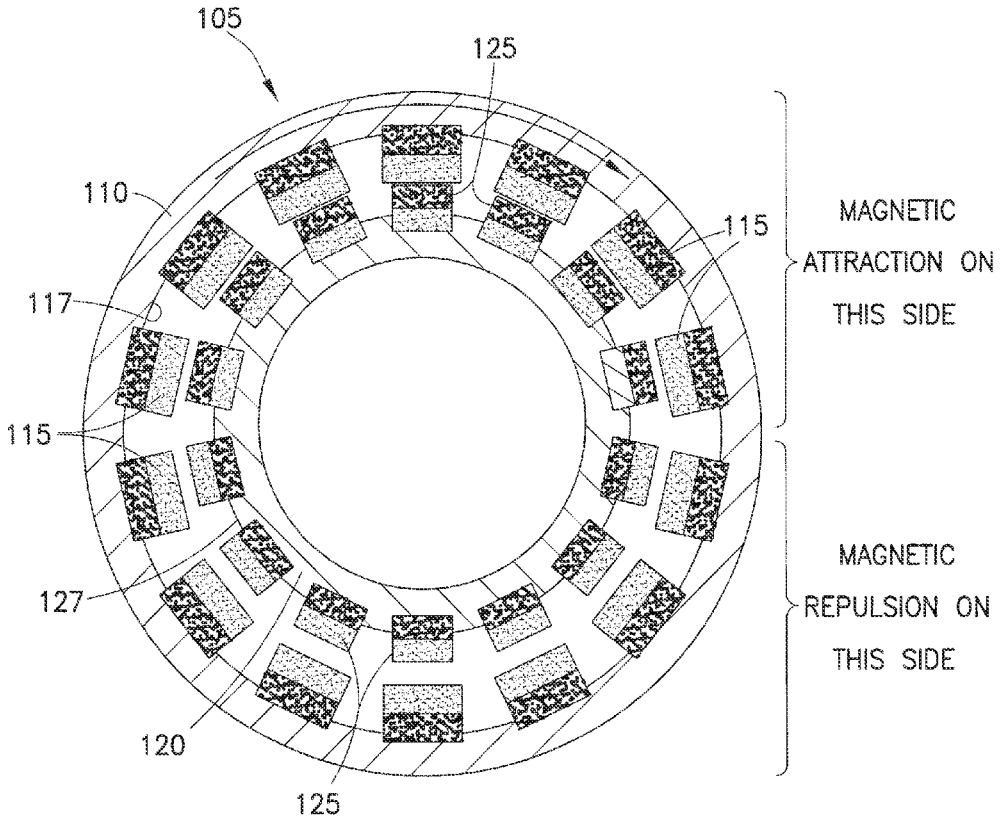
FIG. 1B is a cross-section of a magnetic biasing unit.

FIG. 1B is a cross-sectional view of a magnetic biasing unit 105 that is useful in illustrating concepts described in more detail below. Magnetic biasing unit 105 is shown to include a rotating drill collar 110, a first circumferential array of magnets 115 attached to the inner wall 117 of the collar 110, an essentially geostationary shaft or mandrel 120, and a second circumferential array of magnets 125 attached to the outer wall 127 of the mandrel 120. The magnets of the first array 115 have their magnetic fields radially oriented and have identical polarity (e.g., S pole pointing radially inwards). The magnets of the second array 125 also have their magnetic fields radially oriented. However, a first half of the second array 125 has a first polarity (e.g., N pole pointing radially outwards) and a second half of the second array 125 has a second polarity (e.g., S pole pointing radially outwards) reversed with respect to the first half. As a result, there are attraction forces between the two arrays 115, 125 along one half of the circumference, and repulsion forces between the two arrays 115, 125 along the other half of the circumference, and at any moment in time, there will be a resulting net lateral force between the collar 110 and the inner mandrel 120.

The inner mandrel 120 is kept essentially geostationary, for instance by placing it in between bearings and appropriately controlling the reactive torque, in a non-limiting example from a turbine, so that the flowing drilling mud makes the mandrel rotate relative to the drilling collar with a speed equal and opposite to the drill collar rotation speed, and so that net rotational speed of the inner mandrel with respect to the earth is generally zero. Some techniques for providing a geostationary mandrel are described in co-owned U.S. Pat. No. 6,092,610 to Kosmala et al., which is hereby incorporated by reference herein in its entirety. By keeping the inner mandrel 120 essentially geostationary, the net force between the two arrays of magnets will have a fixed orientation with respect to the earth, even as the collar rotates during drilling. As will be described in more detail hereinafter, the net magnetic force between the collar 110 and the inner mandrel 120 can be used to steer a bit coupled to the collar or mandrel during drilling.

Figure 2A:
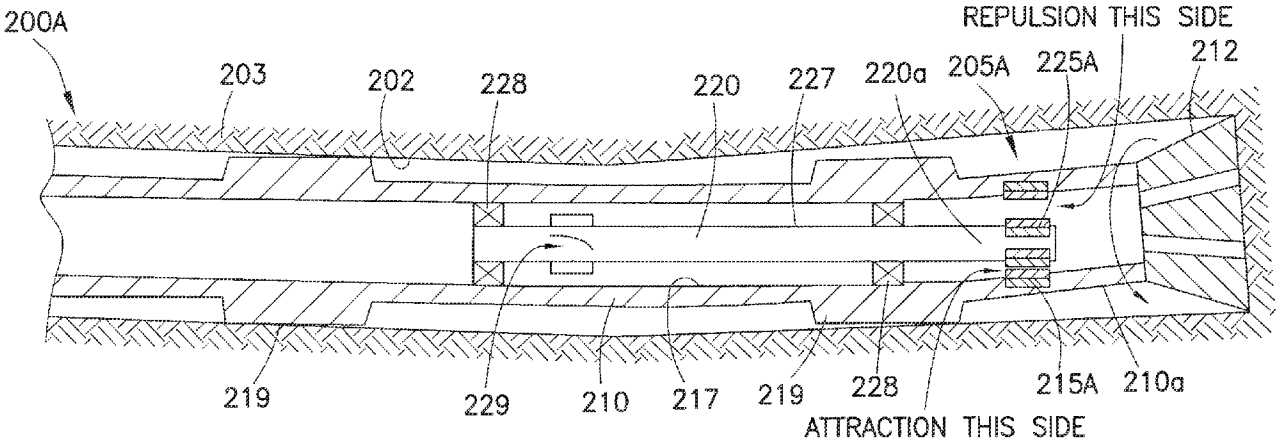
FIG. 2A is a cross-sectional view of one embodiment of a distal end of a drilling operation with a magnetically steered bit located in a formation.

Turning to FIG. 2A, a cross-sectional view is seen of one embodiment of a distal end of a drilling operation 200A in a borehole 202 of a formation 203. Drilling operation 200A includes a rotating collar 210, a drilling bit 212 coupled to the rotating collar 210, an essentially geostationary mandrel 220, and a magnetic biasing unit 205A with a first circumferential array of magnets 215A attached to the inner wall 217 of the collar 210, and a second circumferential array of magnets 225A attached to the outer wall 227 of mandrel 220. As indicated, geostationary mandrel 220 is placed between bearings 228, and the reactive torque from turbine blades 229 are used to keep the mandrel essentially geostationary as the collar 210 rotates. In addition, the collar 210 is shown with stabilizers 219.

In the drilling operation 200A of FIG. 2A, the arrays of magnets 215A and 225A are located at the distal end 220*a* of the mandrel 220 and distal the stabilizers 219. The magnets of array 215A have their magnetic fields radially oriented and have identical polarity (e.g., North pole pointing radially inwards), and the magnets of array 225A also have their magnetic fields radially oriented. However, a first half of the second array 225A has a first polarity (e.g., South pole pointing radially outwards) and a second half has a second polarity (e.g., North pole pointing radially outwards) reversed with respect to the first half. As a result, there are attraction forces between the two arrays 215A, 225A along one half of the circumference (the lower half in the orientation shown in FIG. 2A, with South and North magnets attracting), and repulsion forces between the two arrays along the other half of the circumference (the upper half in the orientation shown in FIG. 2A, with North and North magnets repelling). Thus, in the configuration shown in FIG. 2A, there is a net lateral force between the collar 210 and the inner mandrel 220 causing the distal end 210*a* of the drilling collar 210 to bend upwards, thereby steering bit 212. It is noted that FIG. 2A is not to scale, and the bending of the collar is exaggerated in FIG. 2A to better illustrate the concept. The extent of the bending is at least partially dependent on the strength of the magnets and on the bending stiffness of the drilling collar. The bending stiffness may be controlled based on the selection of material and material thickness of the drilling collar, as well as by the optional provision of slots in the drilling collar or a flexible coupling permitting bending whilst transmitting axial load and torque.

The direction of drilling in the drilling operation 200A of FIG. 2A may be controlled by rotational orientation of the essentially geostationary mandrel 220. By causing the geostationary mandrel to locate its "attracting" magnets toward the bottom of the horizontal borehole 202 and its "repelling" magnets toward the top of the horizontal borehole, the distal end 210*a* of collar 210 is directed upward, and bit 212 is steered upward. Similarly, by causing the essentially geostationary mandrel to rotate by 180 degrees relative to the position shown in FIG. 2A and locate its attracting magnets toward the bottom of the borehole and its repelling magnets toward the top of the borehole, the distal end 210*a* of collar 210 is directed upward and bit 212 is steered downward. By causing the geostationary mandrel to rotate ninety degrees relative to the position shown in FIG. 2A and locate its attracting magnets to the right of the borehole (out of the page) and its repelling magnets to the left of the borehole (into the page), the distal end 210*a* of collar 210 is attracted to the right and the bit 212 is steered toward the left. Conversely, by causing the mandrel to locate its attracting magnets to the left of the borehole and its repelling magnets to the right, the distal end 210*a* of collar 210 is attracted to the left and the bit 212 is steered toward the right. To cause the drill to drill generally straight, the essentially geostationary mandrel may be caused to move to effectively random positions with respect to the earth, or to rotate regularly one hundred eighty degrees in one direction and then one hundred eighty degrees in the other.

The exact implementation for controlling the rotational orientation of the geostationary mandrel is generally considered beyond the scope of this disclosure, but may include, without limitation, motors, gears, sensors, (micro)processors, circuitry, etc., and may be located uphole, downhole, or both uphole and downhole; see by way of example only, U.S. Patent Application Publication 20060249287A1, Nov. 9, 2006 to G. Downton and N. Hale which is hereby incorporated by reference herein in its entirety.

It will be appreciated that the direction of drilling (in all embodiments) is relative. Thus, while drilling in FIG. 2A for a horizontal borehole is described as being steered "up," "down," "left" and "right," for a vertical borehole, the directions may be "forward," "rearward," "leftward" and "rightward" or any other designation.

Figure 2B:
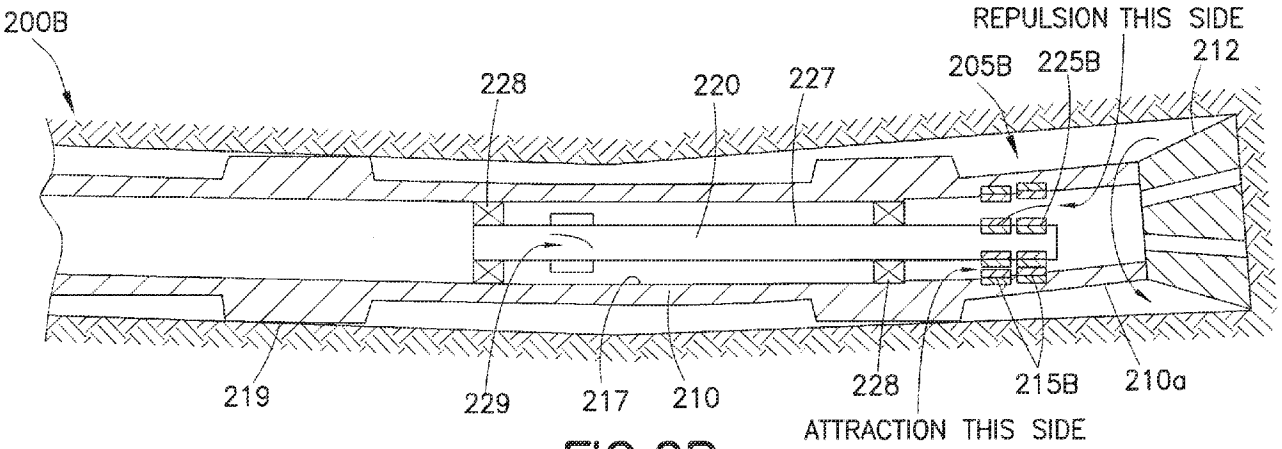
FIG. 2B is a cross-sectional view of another embodiment of a distal end of a drilling operation with a magnetically steered bit located in a formation.

In FIG. 2B another drilling operation 200B is shown, similar to the drilling operation 200A of FIG. 2A, with like numerals designating like parts. Thus, drilling operation 200B includes a rotating collar 210, a drilling bit 212 coupled to the rotating collar 210, an essentially geostationary mandrel 220, and a magnetic biasing unit 205B with a first circumferential array of magnets 215B attached to the inner wall 217 of the collar 210, and a second circumferential array of magnets 225B attached to the outer wall 227 of mandrel 220. As shown in FIG. 2B, magnet array 215B includes multiple axially spaced sets of magnets (two sets shown), and magnet array 225B also includes multiple axially spaced sets of magnets (two sets shown). Also, as indicated, geostationary mandrel 220 is placed between bearings 228, and blades 229 are used to keep the mandrel geostationary as the collar 210 rotates. In addition, the collar 210 is shown with stabilizers 219.

In the drilling operation 200B of FIG. 2B, the arrays of magnets 215B and 225B are located at the distal end 220*a* of the mandrel 220 and distal the stabilizers 219. The magnets of array 215B have their magnetic fields radially oriented and have identical polarity (e.g., North pole pointing radially inwards), and the magnets of array 225B also have their magnetic fields radially oriented. However, a first half of the second array 225A arranged 180 degrees around the mandrel 220 have a first polarity (e.g., South pole pointing radially outwards) and the other half arranged 180 degrees around the other half of the mandrel have a second polarity (e.g., North pole pointing radially outwards) reversed with respect to the first half. As a result, there are attraction forces between the two arrays 215B, 225B along one half of the circumference (the lower half in the orientation shown in FIG. 2B, with South and North magnets attracting), and repulsion forces between the two arrays along the other half of the circumference (the upper half in the orientation shown in FIG. 2B, with North and North magnets repelling). Thus, in the configuration shown in FIG. 2B, there is a net lateral force between the collar 210 and the inner mandrel 220 causing the distal end 210*a* of the drilling collar 210 to bend upwards, thereby steering bit 212. It is noted that FIG. 2B is not to scale, and the bending of the collar is exaggerated in FIG. 2B to better illustrate the concept. The extent of the bending is at least partially dependent on the strength of the magnets and on the bending stiffness of the drilling collar. The bending stiffness may be controlled based on the selection of material and material thickness of the drilling collar, as well as by the elective provision of slots in the drilling collar or a flexible coupling permitting bending whilst transmitting axial load and torque.

The direction of drilling in the drilling operation 200B of FIG. 2B may be controlled by rotational orientation of the essentially geostationary mandrel 220. The exact implementation for controlling the rotational orientation of the essentially geostationary mandrel is considered beyond the scope of this disclosure, but may include, without limitation, motors, gears, sensors, (micro) processors, circuitry, etc., and may be located uphole, downhole, or both uphole and downhole as previously mentioned.

Figure 3A:
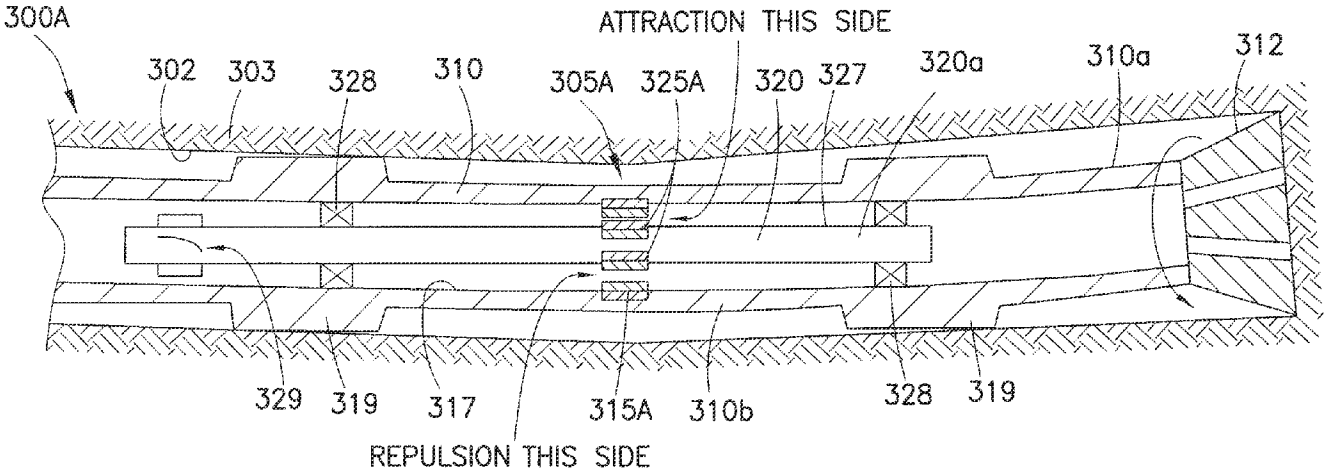
FIG. 3A is a cross-sectional view of another embodiment of a distal end of a drilling operation with a magnetically steered bit located in a formation.

Turning to FIG. 3A, a cross-sectional view is seen of one embodiment of a distal end of a drilling operation 300A in a borehole 302 of a formation 303. Drilling operation 300A includes a rotating collar 310, a drilling bit 312 coupled to the rotating collar 310, an essentially geostationary mandrel 320, and a magnetic biasing unit 305A with a first circumferential array of magnets 315A attached to the inner wall 317 of the collar 310, and a second circumferential array of magnets 325A attached to the outer wall 327 of mandrel 320. As indicated, essentially geostationary mandrel 320 is placed between bearings 328, and blades 329 are used to keep the mandrel geostationary as the collar 310 rotates. In addition, the collar 310 is shown with stabilizers 319.

In the drilling operation 300A of FIG. 3A, the arrays of magnets 315A and 325A are located proximal the distal end 320*a* of the mandrel 320 and proximal the distal bearings 328 and distal stabilizers 319. The magnets of array 315A have their magnetic fields radially oriented and have identical polarity (e.g., North pole pointing radially inwards), and the magnets of array 325A also have their magnetic fields radially oriented. However, a first half of the second array 325A has a first polarity (e.g., South pole pointing radially outwards) and the second half has a second polarity (e.g., North pole pointing radially outwards) reversed with respect to the first half. As a result, there are attraction forces between the two arrays 315A, 325A along one half of the circumference (the upper half in the orientation shown in FIG. 3A, with South and North magnets attracting), and repulsion forces between the two arrays along the other half of the circumference (the lower half in the orientation shown in FIG. 3A, with North and North magnets repelling). Thus, in the configuration shown in FIG. 3A, there is a net lateral force between the collar 310 and the inner mandrel 320 causing the drilling collar 310 at section 310*b* to flex downward between the stabilizers 319, thereby pointing the distal end 310*a* of drill collar 310 upwards, thereby steering bit 312. It is noted that FIG. 3A is not to scale, and the bending of the collar is exaggerated in FIG. 3A to better illustrate the concept. The extent of the bending is at least partially dependent on the strength of the magnets and the bending stiffness of the drilling collar. The bending stiffness may be controlled based on the selection of material and material thickness of the drilling collar, as well as by the optional provision of slots in the drilling collar or a flexible coupling permitting bending whilst transmitting axial load and torque.

The direction of drilling in the drilling operation 300A of FIG. 3A may be controlled by rotational orientation of the essentially geostationary mandrel 320. By causing the geostationary mandrel to locate its "attracting" magnets toward the top of the horizontal borehole 302 and its "repelling" magnets toward the bottom of the horizontal borehole, the collar section 310*b* proximal the distal end 310*a* of collar 310 is pushed downward, thereby causing distal end 310 of collar 310 to be directed or pointed upward, and bit 312 is steered upward. Similarly, by causing the geostationary mandrel to locate its attracting magnets toward the bottom of the borehole and its repelling magnets toward the top of the borehole, the section 310*b* of collar 310 flexes upward, and distal end 310*a* of collar 310 is directed or pointed downward thereby steering bit 312 downward. By causing the geostationary mandrel to locate its attracting magnets to the right of the borehole (out of the page) and its repelling magnets to the left of the borehole (into the page), section 310*b* of collar flexes rightward, and distal end 310*a* of collar 310 is directed or pointed leftward, thereby steering bit 312 toward the left. Conversely, by causing the mandrel to locate its attracting magnets to the left of the borehole and its repelling magnets to the right, section 310*b* of collar flexes leftward, and the distal end 310*a* of collar 310 is directed or pointed to the right and the bit 312 is steered toward the right. To cause the drill to drill straight, the essentially geostationary mandrel 320 may be caused to move to effectively random positions with respect to the earth, or to regularly rotate 180 degrees in one direction and then 180 degrees in the other direction.

Figure 3B:
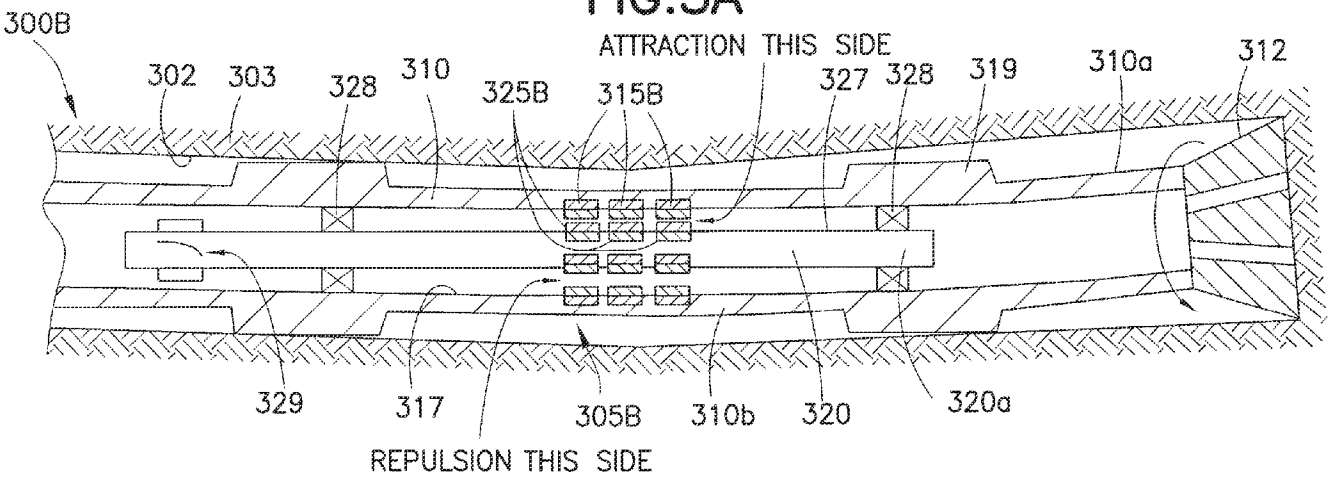
FIG. 3B is a cross-sectional view of another embodiment of a distal end of a drilling operation with a magnetically steered bit located in a formation.

In FIG. 3B another drilling operation 300B is shown, similar to the drilling operation 300A of FIG. 3A, with like numerals designating like parts. Thus, drilling operation 300B includes a rotating collar 310, a drilling bit 312 coupled to the rotating collar 310, an essentially geostationary mandrel 320, and a magnetic biasing unit 305B with a first circumferential array of magnets 315B attached to the inner wall 317 of the collar 310, and a second circumferential array of magnets 325B attached to the outer wall 327 of mandrel 320. As shown in FIG. 3B, magnet array 315B includes multiple axially spaced sets of magnets (three sets shown), and magnet array

325B also includes multiple axially spaced sets of magnets (three sets shown). Also, as indicated, essentially geostationary mandrel 320 is placed between bearings 328, and blades 329 are used to keep the mandrel geostationary as the collar 310 rotates. In addition, the collar 310 is shown with stabilizers 319.

In the drilling operation 300B of FIG. 3B, the arrays of magnets 315B and 325B are located proximal the distal end 320*a* of the mandrel 320 and proximal the distal bearings 328 and distal stabilizers 319. The array of magnets 315B have their magnetic fields radially oriented and have identical polarity (e.g., North pole pointing radially inwards), and the array of magnets 325B also have their magnetic fields radially oriented. However, half of the second array 325B have a first polarity (e.g., South pole pointing radially outwards) and the other half have a second polarity (e.g., North pole pointing radially outwards) reversed with respect to the other half. As a result, there are attraction forces between the two arrays 315B, 325B along one half of the circumference (the upper half in the orientation shown in FIG. 3B, with South and North magnets attracting), and repulsion forces between the two arrays along the other half of the circumference (the lower half in the orientation shown in FIG. 3B, with North and North magnets repelling). Thus, in the configuration shown in FIG. 3B, there is a net lateral force between the collar 310 and the inner mandrel 320 causing the drilling collar 310 at section 310*b* to flex downward between the stabilizers 319, thereby pointing the distal end 310*a* of drill collar 310 upwards, thereby steering bit 312 upwards. It is noted that FIG. 3B is not to scale, and the bending of the collar is exaggerated in FIG. 3B to better illustrate the concept. The extent of the bending is at least partially dependent on the strength of the magnets and on the bending stiffness of the drilling collar. The bending stiffness may be controlled based on the selection of material and material thickness of the drilling collar, as well as by the optional provision of slots in the drilling collar or a flexible coupling permitting bending whilst transmitting axial load and torque.

The direction of drilling in the drilling operation 300B of FIG. 3B may be controlled by rotational orientation of the essentially geostationary mandrel 320. The exact implementation for controlling the rotational orientation of the geostationary mandrel is generally considered beyond the scope of this disclosure, but may include, without limitation, motors, gears, sensors, (micro)processors, circuitry, etc., and may be located uphole, downhole, or both uphole and downhole.

Figure 4:
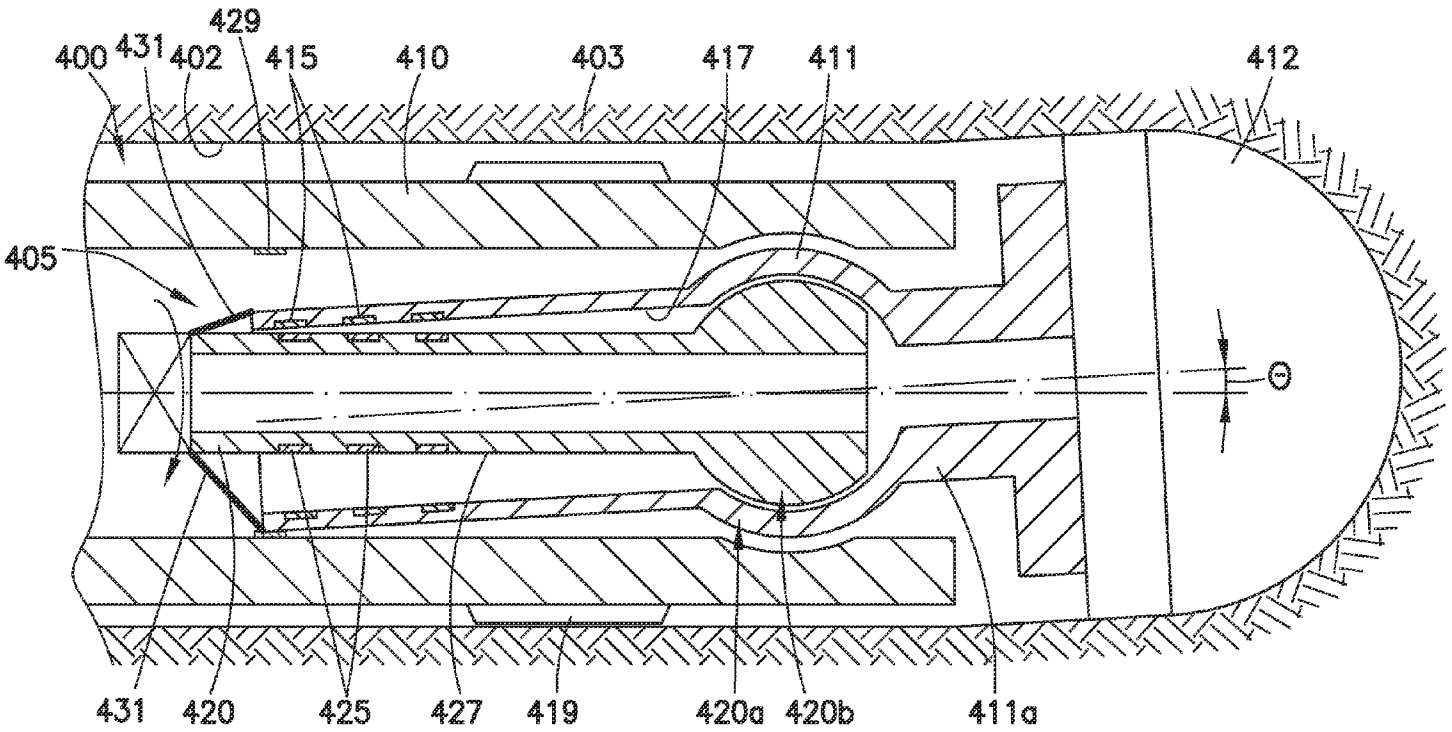
FIG. 4 is a cross-sectional schematic of another embodiment of a distal end of a drilling operation with a magnetically steered bit located in a formation.

In FIG. 4 a cross-sectional view is seen of one embodiment of a distal end of a drilling operation 400 in a borehole 402 of a formation 403. Drilling operation 400 includes a rotating collar 410 coupled via a universal joint (steering) device 411 to a drilling bit 412, an essentially geostationary mandrel 420, and a magnetic biasing unit 405 with a first circumferential array of magnets 415 attached to the inner wall 417 of the universal joint device, and a second circumferential array of magnets 425 attached to the outer wall 427 of mandrel 420. The collar 410 is shown with stabilizers 419. The distal end 420*a* of the geostationary mandrel is provided with a pivot joint 420*b* that allows the essentially geostationary mandrel 420 to rotate relative to the universal joint device 411 and collar 410. The universal joint device 411 is directly attached to the bit 412 and thereby transmits rotation of the collar 410 to the bit while tilting and allowing the bit 412 to tilt (as indicated by angle theta (θ)) relative to both the essentially geostationary mandrel 420 and the collar 410.

In the drilling operation 400 of FIG. 4, the arrays of magnets 415 and 425 are located proximal the pivot joint 420*b* of the mandrel 420. The magnets of array 415 have their magnetic fields radially oriented and have identical polarity (e.g., North pole pointing radially inwards), and the array of magnets 425 also has their magnetic fields radially oriented. However, a first half of the second array 425 has a first polarity (e.g., South pole pointing radially outwards) and the second half has a second polarity (e.g., North pole pointing radially outwards) reversed with respect to the first half. As a result, there are attraction forces between the two arrays 415, 425 along one half of the circumference (the upper half in the orientation shown in FIG. 4, with South and North magnets attracting), and repulsion forces between the two arrays along the other half of the circumference (the lower half in the orientation shown in FIG. 4, with North and North magnets repelling). Thus, in the configuration shown in FIG. 4, there is a net lateral force between the universal joint 411 and the inner mandrel 420 causing the distal end 411*a* of the universal joint element to tilt upwards, thereby steering bit 412 upwards. It is noted that FIG. 4 is not to scale, and the tilting of the bit may be exaggerated in FIG. 4 to better illustrate the concept. In the drilling operation 400 of FIG. 4, the extent of the tilting of the bit 412 is primarily dependent on the strength of the magnets and the parameters of the universal joint and is not particularly dependent on the bending stiffness of the drilling collar 410. In non-limiting examples, the drilling collar 410 may include a travel limit stops (or strike ring) 429. The travel limit stops (or strike ring) limit the extent to which the bit 412 can be tilted with respect to the drilling collar 410. These travel limit stops (or strike ring) 429 can be mounted on the drilling collar 410 or on the geostationary mandrel 420 and can be made adjustable for variation of the maximum dogleg response of the tool. It will be noted that the drilling fluid will pass through the drive shaft 427 and will not come into direct contact with the magnets with suitable sealing elements 431 which in non-limiting examples may be elastomeric or metal bellows.

The direction of drilling in the drilling operation 400 of FIG. 4 may be controlled by rotational orientation of the essentially geostationary mandrel 420. By causing the geostationary mandrel to locate its "attracting" magnets toward the top of the horizontal borehole 402 and its "repelling" magnets toward the bottom of the horizontal borehole, the distal end 411*a* of the universal joint element 411 is directed upward, and bit 412 is steered upward. Similarly, by causing the geostationary mandrel to locate its attracting magnets toward the bottom of the borehole and its repelling magnets toward the top of the borehole, the distal end 411*a* of universal joint element 411 is directed downward and bit 412 is steered downward. By causing the geostationary mandrel to locate its attracting magnets to the right of the borehole (out of the page) and its repelling magnets to the left of the borehole (into the page), the distal end 411*a* of universal joint element 411 is attracted to the right and the bit 412 is steered toward the left. Conversely, by causing the mandrel to locate its attracting magnets to the left of the borehole and its repelling magnets to the right, the distal end 411*a* of universal joint element 411 is attracted to the left and the bit 412 is steered toward the right. To cause the drill to drill straight, the essentially geostationary mandrel may be caused to move to generally random positions with respect to the earth, or to rotate 180 degrees in one direction and then 180 degrees in the other direction. It should be noted that in one embodiment the stabilizer 419 can be located forward of the universal joint element 411 so that it moves with the bit 412. In another embodiment, the stabilizer may be placed on a sleeve that tilts with the bit as in the previously mentioned PowerDrive ARCHER product of the assignee hereof; see by way of example only; U.S. Pat. No.

7,188,685 entitled "Hybrid Rotary Steerable System," to Downton et al., which is hereby incorporated by reference herein in its entirety.

The exact implementation for controlling the rotational orientation of the essentially geostationary mandrel is generally considered beyond the scope of this disclosure, but may include, without limitation, motors, gears, sensors, (micro) processors, circuitry, etc., and may be located uphole, downhole, or both uphole and downhole as previously mentioned.

Figure 5:
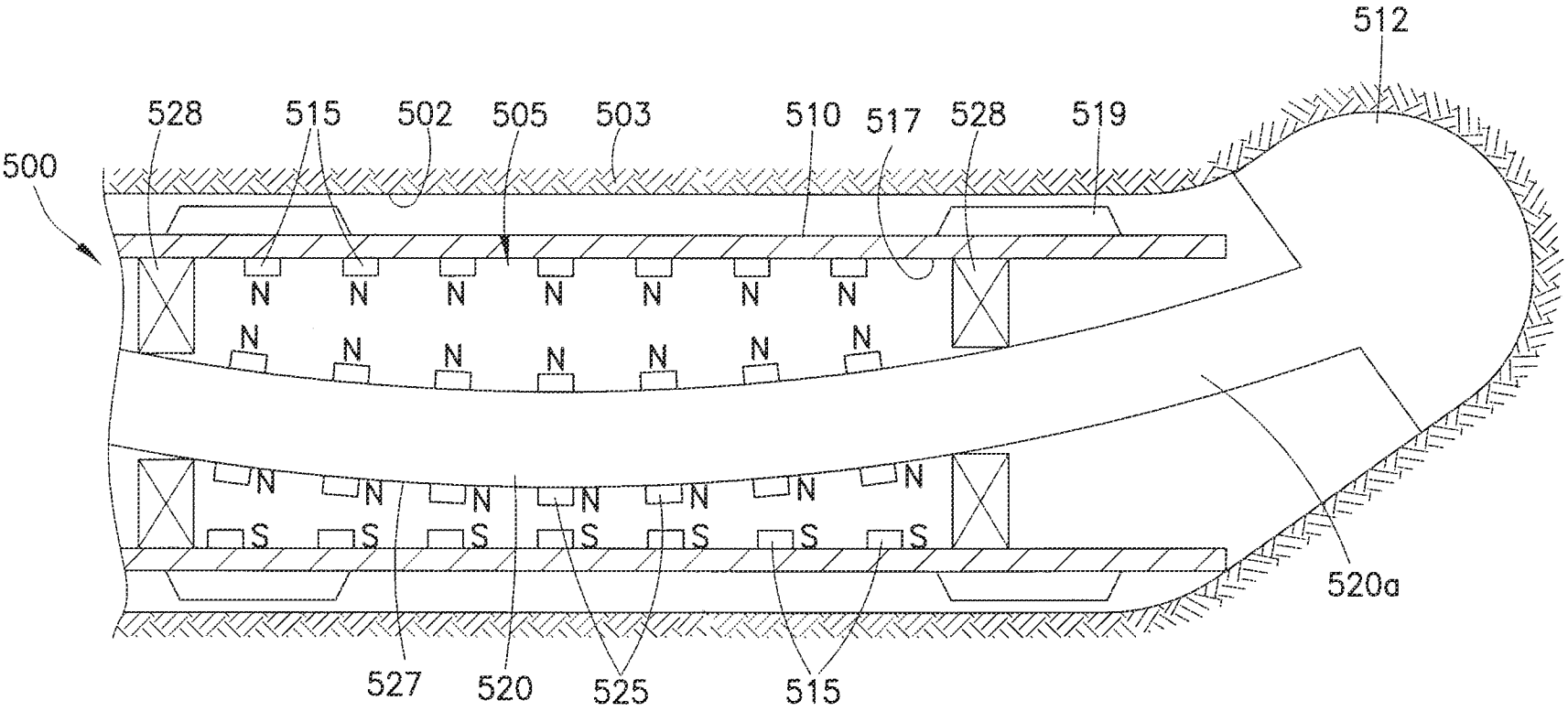
FIG. 5 is a cross-sectional schematic of another embodiment of a distal end of a drilling operation with a magnetically steered bit located in a formation.

Turning now to FIG. 5, a cross-sectional view is seen of one embodiment of a distal end of a drilling operation 500 in a borehole 502 of a formation 503. Drilling operation 500 includes a substantially stationary collar 510 and a mud motor driven shaft 520 to which is attached to a drilling bit 512. If desired, the collar 510 may be the stator collar of the mud motor (not shown). Bearings 528 (optionally spherical in shape) are provided to permit rotation of the shaft 520 relative to the collar 510. A magnetic biasing unit 505 includes a first circumferential array of magnets 515 attached to the inner wall 517 of the collar 510, and a second circumferential array of magnets 525 attached to the outer wall 527 of drive shaft 520. The collar 510 is shown with stabilizers 519.

In the drilling operation 500 of FIG. 5, the arrays of magnets 515 and 525 are located towards the distal end of the collar 510 and drive shaft 520 between the bearings 528. The magnets of array 525 on the drive shaft 520 have their magnetic fields radially oriented and have identical polarity (e.g., North pole pointing radially inwards), and the magnets of array 515 on the collar 510 also have their magnetic fields radially oriented. However, a first half of the array 515 on the collar has a first polarity (e.g., South pole pointing radially outwards) and the second half has a second polarity (e.g., North pole pointing radially outwards) reversed with respect to the first half. As a result, there are attraction forces between the two arrays 515, 525 along one half of the circumference (the lower half in the orientation shown in FIG. 5, with South and North magnets attracting), and repulsion forces between the two arrays along the other half of the circumference (the upper half in the orientation shown in FIG. 5, with North and North magnets repelling). Thus, in the configuration shown in FIG. 5, there is a net lateral force between the drive shaft 520 and the collar 510 causing the distal end 520*a* of the drive shaft to flex, thereby steering bit 512 upwards. It is noted that FIG. 5 is not to scale, and the angling of the shaft 520 and bit 512 is exaggerated in FIG. 5 to better illustrate the concept. In the drilling operation 500 of FIG. 5, the extent of the angling of the bit 512 is primarily dependent on the strength of the magnets and the bending stiffness of the shaft 520. It will be noted that the drilling fluid will pass through the drive shaft 527 and will not come into direct contact with the magnets with suitable sealing elements at the bearings 528.

The direction of drilling in the drilling operation 500 of FIG. 5 may be controlled by rotational orientation of the essentially stationary collar 510. By causing the collar to locate its "attracting" magnets toward the bottom of the horizontal borehole 502 and its "repelling" magnets toward the top of the horizontal borehole, the distal end 520*a* of the drive shaft 520 is bent upward, and bit 512 is steered upward. Similarly, by causing the collar 510 to locate its attracting magnets toward the top of the borehole and its repelling magnets toward the bottom of the borehole, the distal end 520*a* of the drive shaft 520 is directed downward and bit 512 is steered downward. By causing the collar to locate its attracting magnets to the right of the borehole (out of the page) and its repelling magnets to the left of the borehole (into the page), the distal end 520*a* of the drive shaft 520 is directed toward the left and the bit 512 is steered toward the left. Conversely, by causing the collar 510 to locate its attracting magnets to the left of the borehole and its repelling magnets to the right, the distal end 520*a* of drive shaft is directed toward the right and the bit 512 is steered toward the right. To cause the drill to drill straight, the collar 510 may be caused to move to random positions with respect to the earth, or to rotate slowly first in one direction and then in the other.

The exact implementation for controlling the rotational orientation of the collar is generally considered beyond the scope of this disclosure, but may include, without limitation, motors, gears, sensors, (micro)processors, circuitry, etc., and may be located uphole, downhole, or both uphole and downhole.

Figure 6:
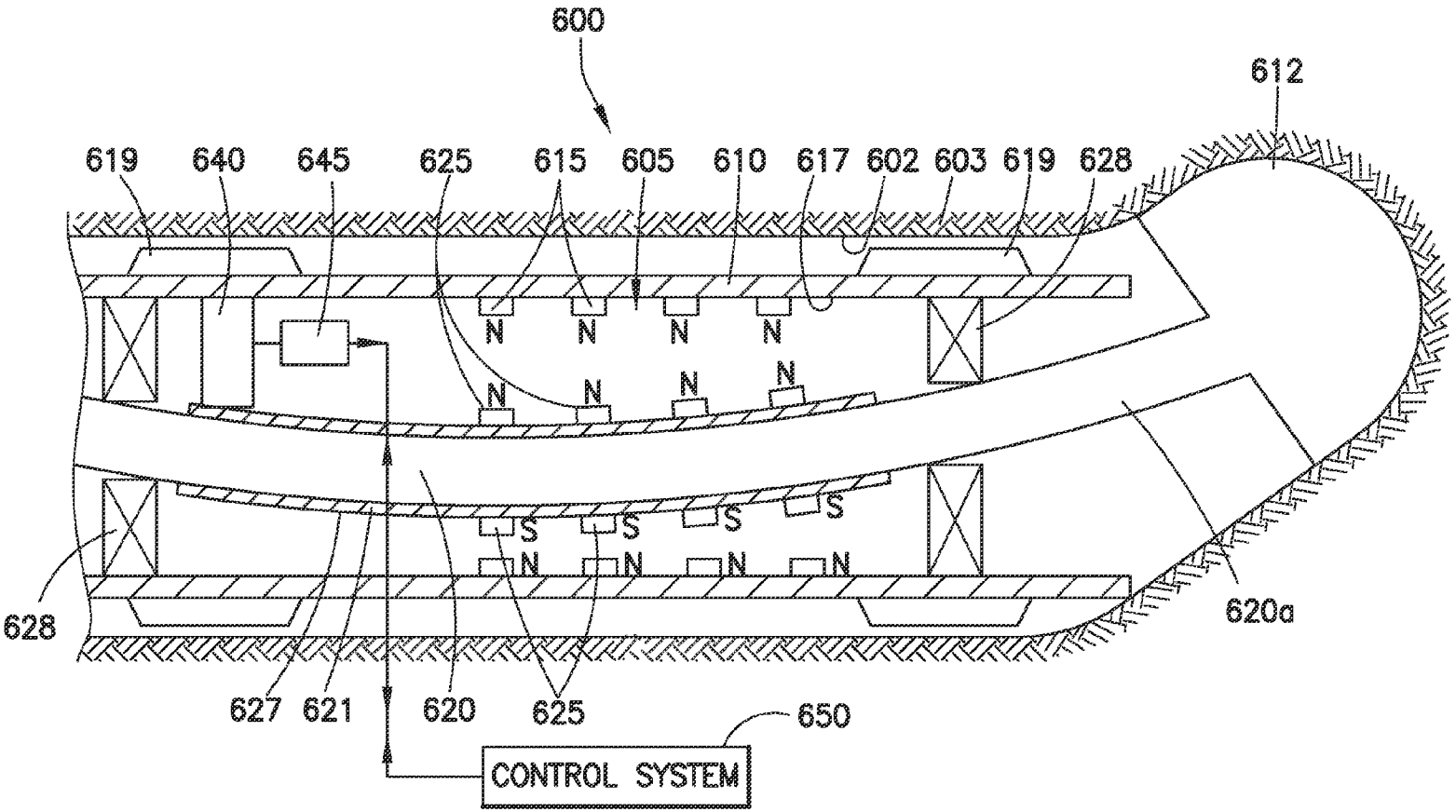
FIG. 6 is a cross-sectional schematic of another embodiment of a distal end of a drilling operation with a magnetically steered bit located in a formation.

Turning now to FIG. 6, a cross-sectional view is seen of one embodiment of a distal end of a drilling operation 600 in a borehole 602 of a formation 603. Drilling operation 600 includes a collar 610 and a shaft 620 to which are attached a drilling bit 612. A rotationally-controllable sleeve 621 surrounds and engages but is rotatable relative to the shaft 620. Rotation of the sleeve 621 is controlled via use of a gear box 640, motor 645 and system controller 650, with the system controller 650 optionally located uphole. In other embodiments, rotation of the sleeve 621 is controlled in other manners. Also, in other embodiments the collar 610 can be a non-rotating stabilizer, a rotating collar that is powered by a motor or by the drill string (not shown), or a stator collar of a mud motor (not shown). In FIG. 6, the collar 610 is shown with stabilizers 619. Bearings 628, which are optionally spherical, are provided to permit rotation of the shaft 620 relative to the collar 610. A magnetic biasing unit 605 includes a first circumferential array of magnets 615 attached to the inner wall 617 of the collar 610, and a second circumferential array of magnets 625 attached to the outer wall 627 of the sleeve 621.

In the drilling operation 600 of FIG. 6, the arrays of magnets 615 and 625 are located along the collar 610 and sleeve 621 between the bearings 628. The magnets of array 615 on the collar 610 have their magnetic fields radially oriented and have identical polarity (e.g., North pole pointing radially inwards), and the magnets of array 625 on the sleeve 621 also have their magnetic fields radially oriented. However, a first half of the array 625 on the sleeve has a first polarity (e.g., South pole pointing radially outwards) and the second half has a second polarity (e.g., North pole pointing radially outwards) reversed with respect to the first half. As a result, there are attraction forces between the two arrays 615, 625 along one half of the circumference (the lower half in the orientation shown in FIG. 6, with South and North magnets attracting), and repulsion forces between the two arrays along the other half of the circumference (the upper half in the orientation shown in FIG. 6, with North and North magnets repelling). Thus, in the configuration shown in FIG. 6, there is a net lateral force between the sleeve 621 and the collar 610 causing the sleeve to displace or flex, thereby causing the drive shaft 620 to flex and direct the steering bit 612 upwards. It is noted that FIG. 6 is not to scale, and the bending of the sleeve 621 and shaft 620 and angling of the bit 612 is exaggerated in FIG. 6 to better illustrate the concept. In the drilling operation 600 of FIG. 6, the extent of the angling of the bit 612 is primarily dependent on the strength of the magnets and the bending stiffnesses of the sleeve 621 and shaft 620.

The direction of drilling in the drilling operation 600 of FIG. 6 may be controlled by having control system 650 control the rotational orientation of the sleeve 621. By keeping the sleeve 621 geostationary and oriented in a particular rotational configuration, the bit 612 is directed in a corresponding direction. Thus, by causing the sleeve 621 to locate its "attracting" magnets toward the bottom of the horizontal borehole 602 and its "repelling" magnets toward the top of the horizontal borehole, the distal end 620*a* of the drive shaft 620 is bent upward, and bit 612 is steered upward. Similarly, by causing the sleeve 621 to locate its attracting magnets toward the top of the borehole and its repelling magnets toward the bottom of the borehole, the distal end 620*a* of the drive shaft 620 is directed downward and bit 612 is steered downward. By causing the sleeve 621 to locate its attracting magnets to the right of the borehole (out of the page) and its repelling magnets to the left of the borehole (into the page), the distal end 620*a* of the drive shaft 620 is directed toward the left and the bit 612 is steered toward the left. Conversely, by causing the sleeve 621 to locate its attracting magnets to the left of the borehole and its repelling magnets to the right, the distal end 620*a* of drive shaft is directed toward the right and the bit 612 is steered toward the right. To cause the drill to drill straight, the sleeve 621 may be caused to move to random positions with respect to the earth, or to rotate 180 degrees in one direction and then 180 degrees in the other direction.

In the embodiment where collar 610 is a non-rotating stabilizer, if collar 610 should start to rotate due to fractional drag of the drive shaft through the bearings 628, then the motor 645 and gear box 640 will chase the slippage to retain the desired steering direction. Similarly, if the collar 610 is attached to a mud motor stator, rotation from the surface can be cancelled in one embodiment by counter-rotating the sleeve 621 using the motor 645 and gear box 640.

Figure 7:
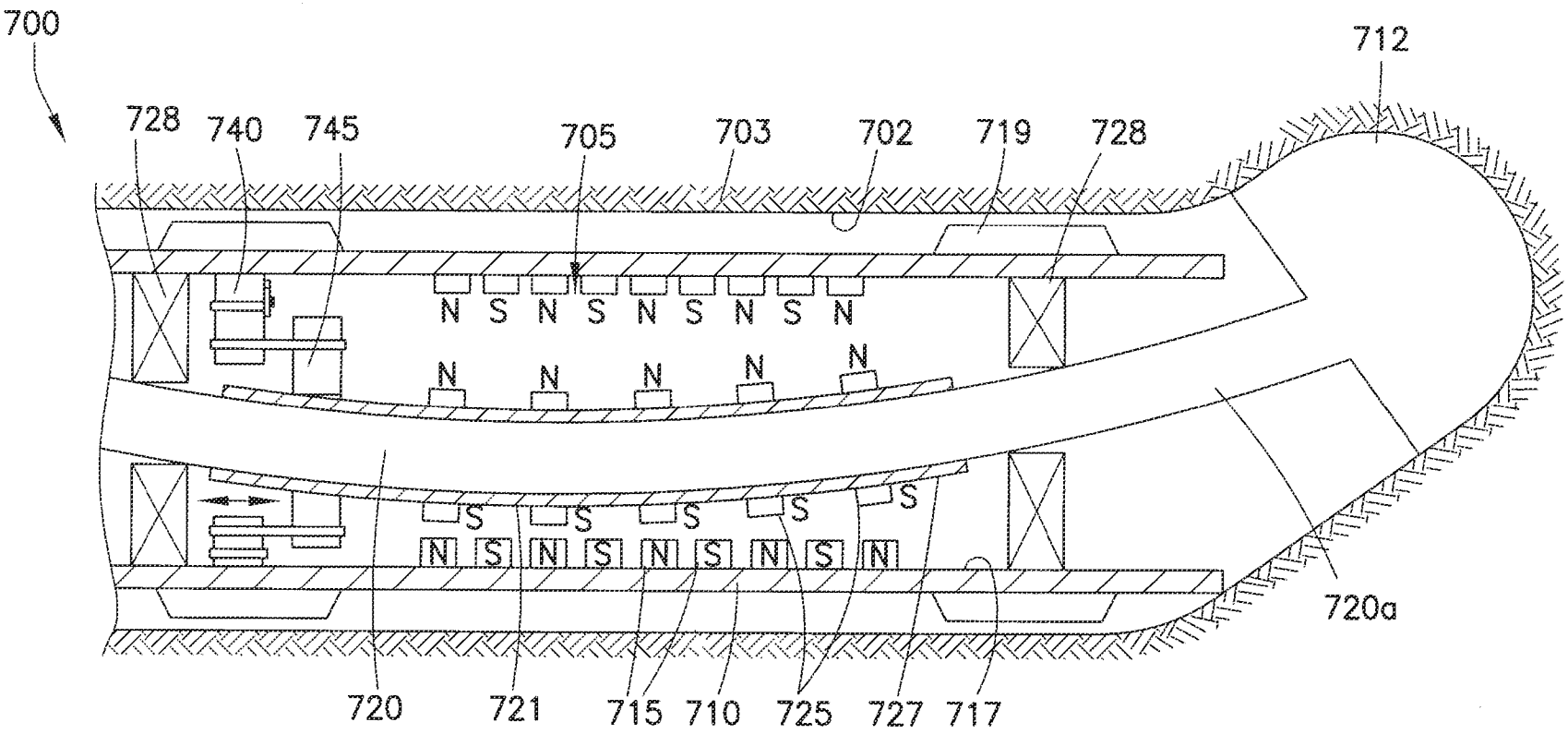
FIG. 7 is a cross-sectional schematic of another embodiment of a distal end of a drilling operation with a magnetically steered bit located in a formation.

Turning now to FIG. 7, a cross-sectional view is seen of one embodiment of a distal end of a drilling operation 700 in a borehole 702 of a formation 703. Drilling operation 700 includes a collar 710 and a shaft 720 to which are attached a drilling bit 712. An axially controllable sleeve 721 surrounds and engages but is axially displaceable relative to the shaft 720; i.e., it may be controllably moved forward and backward. Axial movement of the sleeve 721 is controlled via use of a gear box 740, motor 745, and system controller (not shown), although other arrangements may be utilized. In FIG. 7, the collar 710 is shown with stabilizers 719. Bearings 728 are provided to permit rotation of the shaft 720 relative to the collar 710. A magnetic biasing unit 705 includes a first circumferential array of magnets 715 attached to the inner wall 717 of the collar 710, and a second circumferential array of magnets 725 attached to the outer wall 727 of the sleeve 721.

In the drilling operation 700 of FIG. 7, the arrays of magnets 715 and 725 are located towards the distal end of the collar 710 and sleeve 721 between the bearings 728. The magnets of array 715 on the collar 710 have their magnetic fields radially oriented and axially displaced magnets have alternating polarities (i.e., North, South, North, South poles respectively pointing radially inwards). More particularly, the axial spacing between magnets of array 715 is regular. Magnets at all rotational orientations at a particular axial location have the same polarity, but at adjacent axial locations the polarities are opposite. The magnets of array 725 on the sleeve 721 also have their magnetic fields radially oriented. However, half of the magnets of array 725 on the sleeve have a first polarity (e.g., South pole pointing radially outwards) and the other half have a second polarity (e.g., North pole pointing radially outwards) reversed with respect to the first half. In addition, the magnets of array 725 are more axially spaced than the magnets of array 715 such that array 725 have only half the number of magnets as array 715. With the provided arrays, there are attraction forces between the two arrays 715, 725 along one half of the circumference (the lower half in the orientation shown in FIG. 7, with South and North magnets attracting), and repulsion forces between the two arrays along the other half of the circumference (the upper half in the orientation shown in FIG. 7, with North and North magnets repelling). Thus, in the configuration shown in FIG. 7, there is a net lateral force between the sleeve 721 and the collar 710 causing the sleeve to displace or flex, thereby causing the drive shaft 720 to flex and direct the steering bit 712 upwards. However, if the sleeve 721 of drilling operation 700 is moved forward or backward by the distance of the spacing of the North and South magnets on the collar 710, it will be appreciated that the North magnets on the sleeve 721 will now align with the South magnets on the collar 710 and attract, whereas, the South magnets on the sleeve 721 will align with the south magnets on the collar 710 and repel. As a result, the net lateral force between sleeve 721 and the collar 710 would cause the sleeve to displace or flex and direct the bit 712 downwards. Also, if the sleeve 721 is located such that the magnets 725 of the sleeve are axially located midway between a North and South magnet on the collar 710, the magnetic force on the drive shaft will be nulled and the shaft 720 will straighten and the bit 712 will drill straight ahead. At sleeve displacement positions between a totally aligned position and a midway location (full-force and no-force), the shaft will be bent proportionally, thereby providing a mechanism for proportionally controlling the magnitude of the directional drilling. In the drilling operation 700 of FIG. 7, the extent of the angling of the bit 712 is not only dependent on the strength of the magnets and the axial placement of the sleeve, but is also dependent on the bending stiffnesses of the sleeve 721 and shaft 720. It is noted that FIG. 7 is not to scale, and the bending of the sleeve 721 and shaft 720 and angling of the bit 712 is exaggerated in FIG. 7 to better illustrate the concept.

In one embodiment, sleeve 721 is also rotationally displaceable relative to the shaft 720, and rotation of the sleeve 721 is controlled via use of gear box 740 and motor 745, or through use of a second gear box and motor (not shown). By keeping the sleeve 721 essentially geostationary and oriented in a particular rotational configuration and depending upon the relative axial location, the bit 712 is directed in a desired direction. Thus, by causing the sleeve 721 to locate its "attracting" magnets toward the bottom of the horizontal borehole 702 (and aligned with the opposite polarity magnets of the collar 710) and its "repelling" magnets toward the top of the horizontal borehole, the distal end 720*a* of the drive shaft 720 is bent upward, and bit 712 is steered upward. Similarly, by causing the sleeve 721 to locate its attracting magnets toward the top of the borehole (and aligned with the opposite polarity magnets of the collar) and its repelling magnets toward the bottom of the borehole, the distal end 720*a* of the drive shaft 720 is directed downward and bit 712 is steered downward. By causing the sleeve 721 to locate its attracting magnets to the right of the borehole (out of the page) and aligned with opposite polarity magnets of the collar and its repelling magnets to the left of the borehole (into the page), the distal end 720*a* of the drive shaft 720 is directed toward the left and the bit 712 is steered toward the left. Conversely, by causing the sleeve 721 to locate its attracting magnets to the left of the borehole and its repelling magnets to the right, the distal end 720*a* of drive shaft is directed toward the right and the bit 712 is steered toward the right. To cause the drill to drill straight, as previously mentioned, the sleeve 721 may be axially positioned so that the magnets 725 are axially located midway between a North and South magnet on the collar 710. Axial movement of the sleeve 721 relative to the collar may be used to control the extent of the angling of the bit 712.

According to another embodiment, an inner element such as a mandrel, sleeve or drive shaft can be fitted with a first array of magnets on an outer surface, and an outer element such as a collar can be fitted with a second array of magnets on an inner surface. Both magnet arrays are permitted to rotate with the tool. Sensors (e.g., accelerometer, magnetometer, gyro or an appropriate combination) can be placed on the mandrel, the sleeve, drive shaft, or other element to keep track of the instantaneous tool orientation with respect to the earth. At least one of the magnetic arrays can comprise electromagnets whose polarity and strength may be controlled. Based on the information from the sensors as to the instantaneous tool orientation with respect to the earth, the magnetic field strengths of the electromagnets can be independently controlled based on their individual orientations so as to make the electromagnetic array effectively behave as a geostationary array of permanent magnets. In this manner, the drilling direction may be controlled in manners previously described.

According to one embodiment, magnets placed on one or more a collar, a mandrel, a drive shaft, and a sleeve of a drilling operation are profiled in terms of strength and location. In this manner, beam loads may be controllably spread.

According to one embodiment, one or more of a collar, a mandrel, a drive shaft and a sleeve of a drilling operation are made from a plastic material or a composite material.

Figure 8:
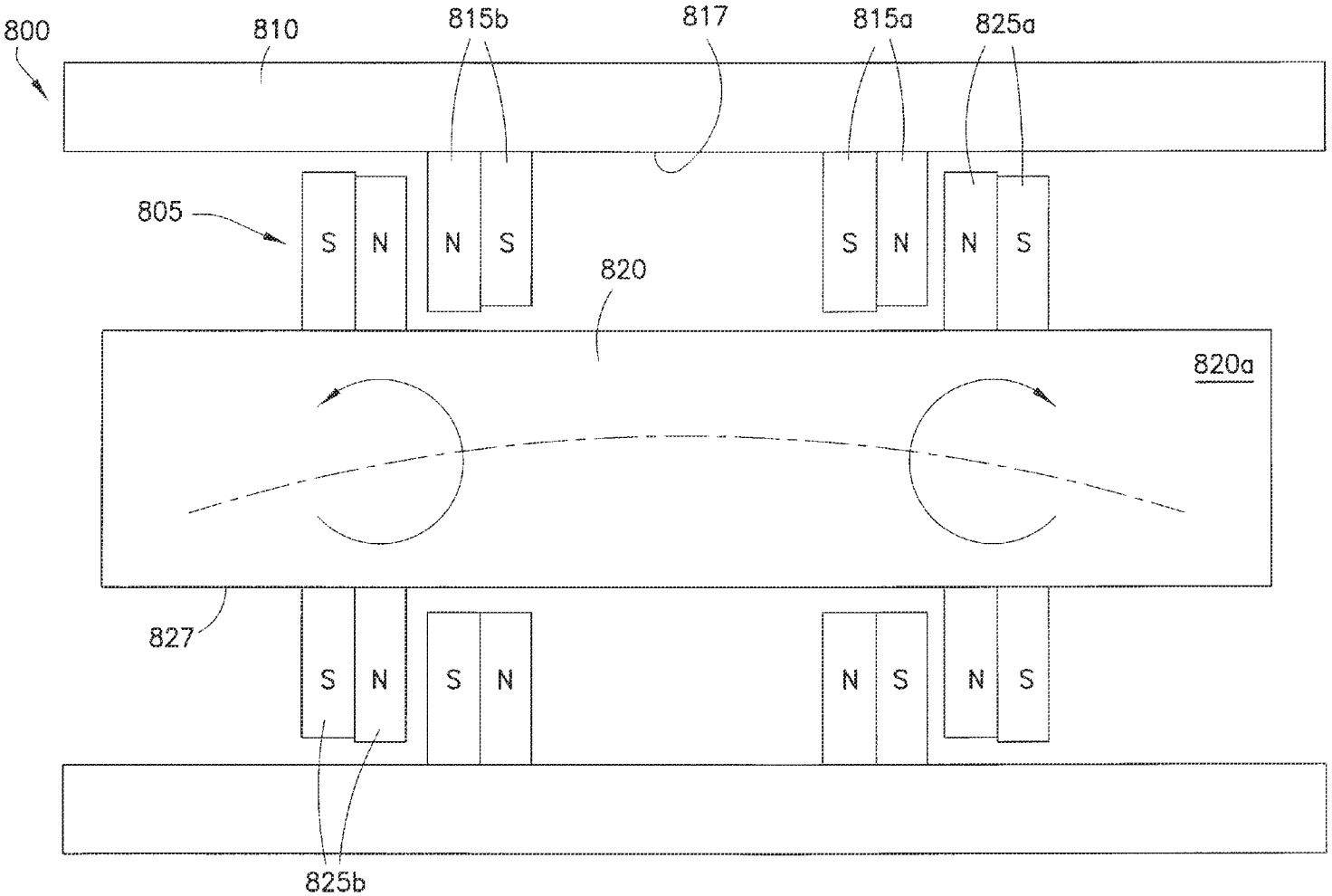
FIG. 8 is a cross-sectional schematic of another embodiment of a distal end of a drilling operation with a magnetically steered bit location in a formation.

Turning to FIG. 8, a cross-sectional view is seen of one embodiment of a distal end of a drilling operation 800 in a borehole (not shown) of a formation (not shown). Drilling operation 800 includes an outer tube (e.g., a collar) 810, a drilling bit (not shown), an inner elongate member (e.g., a mandrel) 820, and a magnetic biasing unit 805 with a first and second axially spaced circumferential arrays of magnets 815*a*, 815*b* attached to the inner wall 817 of the collar 810, and third and fourth axially spaced circumferential arrays of magnets 825*a*, 825*b* attached to the outer wall 827 of mandrel 820. The drill bit may be attached or coupled to the inner elongate member 820 or the outer tube 810 as desired. While the inner elongate member 820 is shown as rotating in FIG. 8 with the outer tube 810 being essentially geostationary, it will be appreciated that other arrangements could be utilized as described above with respect to other embodiments.

In the drilling operation 800 of FIG. 8, the arrays of magnets 815*a*, 815*b*, 825*a* and 825*b* are located proximal the distal end 820*a* of the mandrel 820. The magnets of all of the arrays have their magnetic fields axially oriented. In one embodiment, as shown, array 825*a* has pairs of first polarity magnets (e.g., South) and second polarity magnets (e.g., North) extending completely around the circumference of the mandrel 820, with the South magnets located distal (toward the distal end 820*a* of the mandrel) of the North magnets. Array 815*a*, which is located proximally of array 825*a*, also has pairs of first polarity magnets and second polarity magnets extending completely around the inner surface 817 of the collar 810. However, a first half of the array 815*a* (i.e., halfway around the inner surface) has one polarity (e.g., North) distally located and the other polarity (e.g., South) proximally located, and the second half has a second polarity (e.g., South) distally located and the first polarity (North) proximally located. If the collar 810 is stationary and the mandrel 820 rotates, it will be appreciated that respective adjacent North polarity magnets from arrays 825*a* and 815*a* will repel each other while respective adjacent North polarity magnets from array 825*a* and South polarity magnets from array 815*a* will attract each other. As a result, there are axial attraction forces between the two arrays 815*a*, 825*a* along one half of the circumference (the lower half in the orientation shown in FIG. 8, with South and North magnets attracting), and axial repulsion forces between the two arrays along the other half of the circumference (the upper half in the orientation shown in FIG. 8, with North and North magnets repelling).

A similar arrangement is seen with respect to arrays 815*b* and 825*b*. Array of 825*b* has pairs of first polarity magnets (e.g., South) and second polarity magnets (e.g., North) extending completely around the circumference of the mandrel 820, with the South magnets located distal of the North magnets. Array 815*b*, which is located proximally of array 825*b*, also has pairs of first polarity magnets and second polarity magnets extending completely around the inner surface 817 of the collar 810. However, a first half of the array 815*b* (i.e., halfway around the inner surface) has one polarity (e.g., North) distally located and the other polarity (e.g., South) proximally located, and the second half has a second polarity (e.g., South) distally located and the first polarity (North) proximally located. If the collar 810 is stationary and the mandrel 820 rotates, it will be appreciated that respective adjacent North polarity magnets from arrays 825*b* and 815*b* will repel each other while respective adjacent North polarity magnets from array 825*b* and South polarity magnets from array 815*b* will attract each other. As a result, there are axial attraction forces between the two arrays 815*b*, 825*b* along one half of the circumference (the lower half in the orientation shown in FIG. 8, with South and North magnets attracting), and axial repulsion forces between the two arrays along the other half of the circumference (the upper half in the orientation shown in FIG. 8, with North and North magnets repelling).

With the repulsion forces between arrays 815*a* and 825*a* and 815*b* and 825*b* located at the upper half of the arrangement, and with arrays 815*a* and 815*b* being located between arrays 825*a* and 825*b*, the upper portion of tube or collar 810 is put into a state of compression. Similarly, with the attraction forces between 815*a* and 825*a* and 815*b* and 825*b* located at the lower half of the arrangement, and with arrays 815*a* and 815*b* being located between arrays 825*a* and 825*b*, the lower portion of tube or collar 810 is put into a state of tension. It should be appreciated with respect to FIG. 8, that collar 810 can be rotated one hundred eighty degrees from the orientation shown so that the lower portion is in a state of compression and the upper portion is in a state of tension. Likewise, by rotating ninety degrees in either direction, the portion of the collar 810 that is in a state of compression may be oriented in a direction that is in or out of the page, and the reverse for the portion of the collar 810 that is in a state of tension. Regardless, these bending loads can be used to steer the drilling bit.

To cause the drill to drill straight, the collar 810 may be caused to move to random positions with respect to the earth, or to rotate slowly first in one direction and then in the other. The exact implementation for controlling the rotational orientation of the collar is generally considered beyond the scope of this disclosure, but may include, without limitation, motors, gears, sensors, (micro)processors, circuitry, etc., and may be located uphole, downhole, or both uphole and downhole.

Various aspects of different embodiments may be used in conjunction with each other. Thus, by way of example only, the system shown in FIG. 8 can be modified to include a geostationary sleeve or mandrel in conjunction with a rotating collar, and the magnetic arrays changed such that the arrays on the sleeve or mandrel have polarity changes half way around the circumference, whereas the arrays on the collar are uniform around the inner surface of the collar.

According to one embodiment, rather than providing magnets of one polarity 180 degrees around a collar, a mandrel, a drive shaft, or a sleeve of a drilling operation, and magnets of a second polarity the other 180 degrees around the collar, mandrel, drive shaft, or sleeve, the magnets of the different polarities could extend different extents around. Thus, by way of example only, each might extend only ninety degrees around, with gaps of ninety degrees between them. Or by way of example only, the magnets of one polarity might extend 200 degrees around, and the magnets of another polarity might extend 160 degrees around.

According to one embodiment, rather than providing magnets of one polarity 180 degrees around a collar, a mandrel, a drive shaft, or a sleeve of a drilling operation, and magnets of a second polarity the other 180 degrees around the collar, mandrel, drive shaft, or sleeve, magnets of only a single polarity are extended partially around collar, mandrel, drive shaft, or sleeve. Thus, rather than having a push-pull arrangement, a push only or pull only arrangement could be provided.

According to one embodiment, magnets applied to one or more of a collar, a mandrel, a drive, and a sleeve of a drilling operation for use in controlling drilling direction may be provided as electromagnets. According to another embodiment the polarity of one or more arrays of electromagnets on a collar, a mandrel, a drive or a sleeve of a drilling operation for controlling drilling direction may be controllably switched. According to another embodiment, electromagnets on a collar, mandrel, drive or sleeve of a drilling operation for controlling drilling direction may be controllably switched on or off.

According to one aspect, different aspects of one or more of the previously described embodiments may be combined to control the drilling direction of a drilling operation.

According to one aspect, one or more seals may be provided in conjunction with any of the embodiments to prevent ingress by magnetic particulates into the portion of the tool containing magnets. The seals can be elastomeric seals, flexible bellows or other seals known in the art.

Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims. In the claims, means-plus-function clauses, if any, are intended to cover the structures described herein as performing the recited function and not only structural equivalents, but also equivalent structures. Thus, it is the express intention of the applicant not to invoke 35 U.S.C. §112, paragraph 6 for any limitations of any of the claims herein, except for those in which the claim expressly uses the words 'means for' together with an associated function.

What is claimed is:

1. A directional drilling apparatus, comprising:

a tubular member having an inner surface;

an elongated member having an outer surface and extending inside said tubular member;

a controller that controls at least one of a rotational and an axial alignment of said tubular member and said elongated member;

a drilling bit coupled to one of said tubular member and said elongated member;

a first array of magnets coupled to said tubular member;

a second array of magnets coupled to said elongated member, wherein said first array of magnets and said second array of magnets are arranged in a first configuration controlled by said controller to provide a net lateral force to said one of said tubular member and said elongated member coupled to said drilling bit, the net lateral force directionally controlling said drilling bit.

2. A directional drilling apparatus according to claim 1, wherein:

said tubular member is a drill collar.

3. A directional drilling apparatus according to claim 2, wherein:

said elongated member is an essentially geostationary mandrel.

4. A directional drilling apparatus according to claim 3, wherein:

said drilling bit is coupled to said drill collar.

5. A directional drilling apparatus according to claim 4, further comprising:

first and second sets of bearings, axially spaced and located between said outer surface of said mandrel and said inner surface of said drill collar, said second set of bearings located distal said first set of bearings, wherein said first array of magnets and said second array of magnets are located axially between said second set of bearings and said drilling bit.

6. A directional drilling apparatus according to claim 4, further comprising:

first and second sets of bearings, axially spaced and located between said outer surface of said mandrel and said inner surface of said drill collar, said second set of bearings located distal said first set of bearings, wherein said first array of magnets and said second array of magnets are located axially between said first set of bearings and said second set of bearings.

7. A directional drilling apparatus according to claim 1, wherein:

said elongated member is an essentially geostationary mandrel.

8. A directional drilling apparatus according to claim 1, further comprising:

a universal joint member positioned between said inner surface of said tubular member and said outer surface of said elongated member and coupled to said tubular member, wherein said first array of magnets is positioned on an inner surface of said universal joint member, and said drilling bit is attached to said universal joint member.

9. A directional drilling apparatus according to claim 8, wherein:

said elongated member is an essentially geostationary mandrel.

10. A directional drilling apparatus according to claim 9, wherein:

said first array of magnets extend circumferentially around said inner surface of said universal joint member, are radially oriented and have a first polarity, and said second array of magnets extend circumferentially around said outer surface of said essentially geostationary mandrel, and are radially oriented, wherein a first group of said second array of magnets have said first polarity, and a second group of said second array of magnets have a second polarity opposite said first polarity.

11. A directional drilling apparatus according to claim 10, wherein:

said first group of said second array of magnets extends substantially a first 180 degrees about said outer surface of said essentially geostationary mandrel, and said second group of said second array of magnets extends substantially a second 180 degrees about said outer surface of said essentially geostationary mandrel.

12. A directional drilling apparatus according to claim 1, wherein:

said tubular member is a substantially stationary collar, and said elongated member is a rotating shaft connected to said drilling bit.

13. A directional drilling apparatus according to claim 12, wherein:

said elongated member is a shaft of a mud motor and said substantially stationary collar is a stator collar of said mud motor.

14. A directional drilling apparatus according to claim 12, further comprising:

first and second sets of bearings, axially spaced and located between said outer surface of said elongated member and said inner surface of said collar, said second set of bearings located distal said first set of bearings, wherein said first array of magnets and said second array of magnets are located axially between said first set of bearings and said second set of bearings.

15. A directional drilling apparatus according to claim 12, wherein:

said controller controls said rotational orientation of said tubular member.

16. A directional drilling apparatus according to claim 1, further comprising:

a sleeve positioned between said inner surface of said tubular member and said outer surface of said elongated member and rotationally coupled to said elongated member, wherein said second array of magnets is positioned on an outer surface of said sleeve, said elongated member is a drive shaft, and said drilling bit is attached to said drive shaft.

17. A directional drilling apparatus according to claim 16, further comprising:

first and second sets of bearings, axially spaced and located between said outer surface of said drive shaft and said inner surface of said tubular member, said second set of bearings located distal said first set of bearings, wherein said first array of magnets and said second array of magnets are located axially between said first set of bearings and said second set of bearings.

18. A directional drilling apparatus according to claim 16, wherein:

said sleeve is axially displaceable relative to said drive shaft.

19. A directional drilling apparatus according to claim 16, wherein:

said first array of magnets includes a plurality of sets of magnets axially spaced from each other with each set extending circumferentially around said inner surface of said tubular member, being radially oriented and having a first polarity, and said second array of magnets includes a plurality of sets of magnets axially spaced from each other with each set extending circumferentially around said outer surface of said sleeve, being radially oriented, wherein a first group of each set of said second array of magnets has said first polarity, and a second group of each set of said second array of magnets has a second polarity opposite said first polarity.

20. A directional drilling apparatus according to claim 19, wherein:

said controller controls said rotational orientation of said sleeve.

21. A directional drilling apparatus according to claim 19, wherein:

said first group of each set of said second array of magnets extends substantially a first 180 degrees about said outer surface of said sleeve, and said second group of each set of said second array of magnets extends substantially a second 180 degrees about said outer surface of said sleeve.

22. A directional drilling apparatus according to claim 1, further comprising:

a sleeve positioned between said inner surface of said tubular member and said outer surface of said elongated member and coupled but axially displaceable relative to said elongated member, wherein said second array of magnets is positioned on an outer surface of said sleeve, said elongated member is a drive shaft, and said drilling bit is attached to said drive shaft.

23. A directional drilling apparatus according to claim 22, wherein:

said first array of magnets includes a first plurality of sets of magnets axially spaced from each other with each set extending circumferentially around said inner surface of said tubular member, being radially oriented and with a first group of said sets having a first polarity, and a second group of said sets having a second polarity opposite said first polarity, wherein said first group and second group are alternatingly axially interspersed, and said second array of magnets includes a second plurality of sets of magnets extending circumferentially around said outer surface of said sleeve, being radially oriented, wherein a first group of each set of said second array of magnets has said first polarity, and a second group of each set of said second array of magnets has said second polarity, and wherein said first plurality of sets is substantially twice in number said second plurality of sets.

24. A directional drilling apparatus according to claim 23, wherein:

said controller controls said axial displacement of said sleeve.

25. A directional drilling apparatus according to claim 24, wherein:

said sleeve is rotationally coupled to said elongated member and said controller controls rotational orientation of said sleeve.

26. A directional drilling apparatus according to claim 1, wherein:

said first array of magnets extend circumferentially around said inner surface of said tubular member, are radially oriented and have a first polarity, and said second array of magnets extend circumferentially around said outer surface of said elongated member, and are radially oriented, wherein a first group of said second array of magnets have said first polarity, and a second group of said second array of magnets have a second polarity opposite said first polarity.

27. A directional drilling apparatus according to claim 26, wherein:

said controller controls said rotational orientation of said elongated member.

28. A directional drilling apparatus according to claim 26, wherein:

said first group of said second array of magnets extends substantially a first 180 degrees about said outer surface of said elongated member, and said second group of said second array of magnets extends substantially a second 180 degrees about said outer surface of said elongated member.

29. A directional drilling apparatus according to claim 1, wherein:

said first array of magnets extend circumferentially around said inner surface of said tubular member, are radially oriented, and a first group of said first array of magnets have a first polarity, and a second group of said first array of magnets have a second polarity opposite said first polarity, and said second array of magnets extend circumferentially around said outer surface of said elongated member, and are radially oriented and have said first polarity.

30. A directional drilling apparatus according to claim 29, wherein:

said first group of said first array of magnets extends substantially a first 180 degrees about said inner surface of said tubular member, and said second group of said first array of magnets extends substantially a second 180 degrees about said inner surface of said tubular member.

31. A directional drilling apparatus according to claim 1, wherein:

at least one of said first array of magnets and said second array of magnets are electromagnets.

32. A directional drilling apparatus, comprising:

a tubular member having an inner surface;

an elongated member having an outer surface and extending inside said tubular member;

a controller that controls at least one of a rotational and an axial alignment of said tubular member and said elongated member;

a drilling bit coupled to one of said tubular member and said elongated member;

a first array of magnets including a first group of magnets and a second group of magnets coupled to said tubular member;

a second array of magnets coupled to said elongated member includes a third group of magnets and a fourth group of magnets, wherein said first array of magnets and said second array of magnets are arranged in a first configuration controlled by said controller to provide a net axial force to said one of said tubular member and said elongated member coupled to said drilling bit, the net axial force thereby directionally controlling said drilling bit; and said first group of magnets and said second group of magnets are located axially between said third group of magnets and said fourth group of magnets.

33. A directional drilling apparatus according to claim 32, wherein:

said first group of magnets extending in a first polarity arrangement partially around said inner surface of said tubular member and extending in a second polarity arrangement opposite said first polarity arrangement partially around said inner surface, and said second group of magnets extending in a third polarity arrangement partially around said inner surface of said tubular member and extending in a fourth polarity arrangement opposite said third polarity arrangement partially around said inner surface; and said third group of magnets extending around said outer surface of said elongated member in said first polarity arrangement and said fourth group of magnets extending around said outer surface of said elongated member in said second polarity arrangement.

34. A method for directionally drilling an earth formation, comprising:

locating a directional drilling apparatus in the formation, said directional drilling apparatus comprising a tubular member having an inner surface, an elongated member having an outer surface and extending inside said tubular member, a controller that controls at least one of a rotational and an axial alignment of said tubular member and said elongated member, a drilling bit coupled to one of said tubular member and said elongated member, a first array of magnets coupled to said tubular member, and a second array of magnets coupled to said elongated member;

using said controller to cause said first array of magnets and said second array of magnets to assume a first configuration relative to each other to provide a first directional net lateral force to said one of said tubular member and said elongated member coupled to said drilling bit, thereby causing said drilling bit to drill in a first direction; and using said controller to cause said first array of magnets and said second array of magnets to assume a second configuration relative to each other to provide a second directional net lateral force different than said first directional net lateral force to said one of said tubular member and said elongated member coupled to said drilling bit, thereby causing said drilling bit to drill in a second direction different than said first direction.

35. A method according to claim 34, further comprising:

causing one of said tubular member and said elongated member to be an essentially geostationary member.

* * * * *